United States Patent [19]

Allen

[11] 4,083,143

[45] Apr. 11, 1978

[54] CONTROL ARRANGEMENT FOR TOY AND MODEL VEHICLES

[76] Inventor: John Allen, 15 Ridge Road, Winchmore Hill, London N21 3EB, England

[21] Appl. No.: 615,193

[22] Filed: Sep. 22, 1975

Related U.S. Application Data

[63] Continuation-in-part of Ser. No. 340,839, Mar. 13, 1973, Pat. No. 3,939,605.

[30] Foreign Application Priority Data

Mar. 15, 1972 United Kingdom ..... 12174/72

[51] Int. Cl.[2] ..... A63H 17/25

[52] U.S. Cl. ..... 46/204; 46/107

[58] Field of Search ..... 46/39, 201, 204, 205, 46/209, 107, 106

[56] References Cited

U.S. PATENT DOCUMENTS

| | | | |
|---|---|---|---|
| 1,091,950 | 3/1914 | Nagy | 46/107 |
| 1,356,901 | 10/1920 | Barger | 46/107 |
| 1,382,967 | 6/1921 | Foans | 46/107 |
| 1,461,109 | 7/1923 | Cable | 46/107 |
| 1,461,651 | 7/1923 | Fox | 46/107 |
| 1,476,199 | 12/1923 | Gazda | 46/107 |
| 1,506,526 | 8/1924 | Hornastaj | 46/107 |
| 1,571,071 | 1/1926 | Sweet | 46/107 |
| 1,643,916 | 9/1927 | Becker | 46/107 |
| 1,646,169 | 10/1927 | Rosenbaum | 46/201 |
| 2,509,805 | 5/1950 | Briggs | 46/107 |
| 2,724,925 | 11/1955 | Fisher et al. | 46/204 X |
| 2,726,482 | 12/1955 | Roehol et al. | 46/204 |
| 3,024,566 | 3/1962 | Licitis | 46/204 X |
| 3,238,665 | 3/1966 | Doe | 46/204 X |
| 3,708,912 | 1/1973 | Doe | 46/204 |

FOREIGN PATENT DOCUMENTS

| | | | |
|---|---|---|---|
| N8,824 | 10/1956 | Germany | 46/107 |

*Primary Examiner*—F. Barry Shay

*Attorney, Agent, or Firm*—Haseltine, Lake & Waters

[57] ABSTRACT

A toy or model vehicle having ground wheels, of which at least one is formed with a cam or lobe that cooperates with a pivotable or reciprocable member mounted in the vehicle, or with an intermediate member transmitting such motion, whereby such items as simulated engine pistons, toy figures of animals and men, and gun turrets, for example, may be given movement during travel of the vehicle over a surface.

6 Claims, 9 Drawing Figures

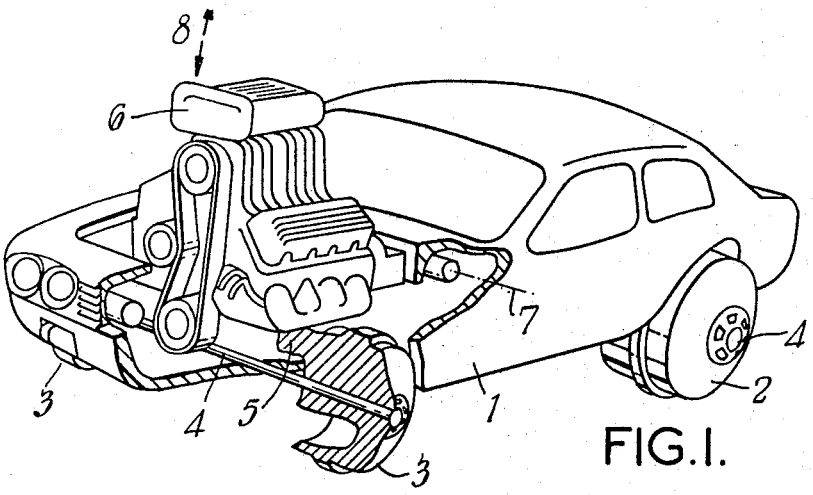
FIG.1.
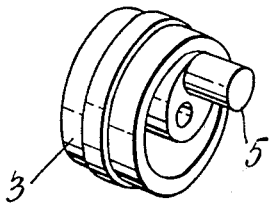
FIG.2.
FIG.3.
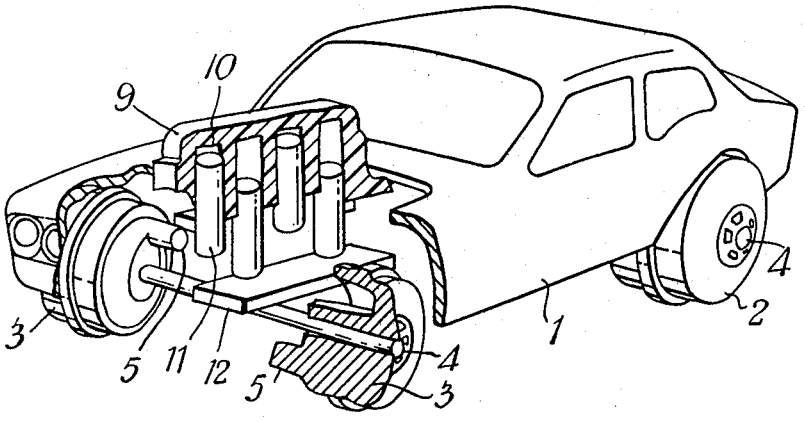

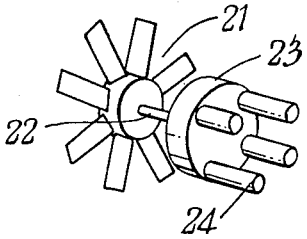
FIG.6.
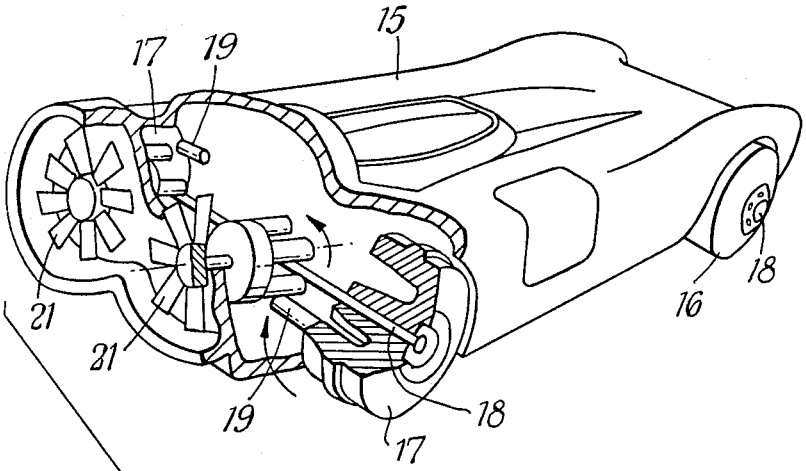
FIG.5.
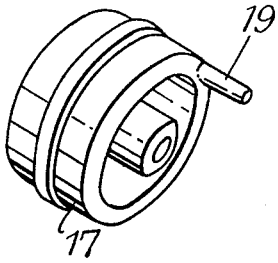

CONTROL ARRANGEMENT FOR TOY AND MODEL VEHICLES

BACKGROUND OF THE INVENTION

This is a continuation-in-part of the parent application Ser. No. 340,839 filed Mar. 13, 1973 now U.S. Pat. No. 3,939,605.

This invention relates to toy or model vehicles, particularly unpowered toy or model vehicles.

It is an object of the invention to increase the novelty and interest of such vehicles by providing them with parts that reciprocate or rotate relative to the chassis of the vehicle.

According to the invention there is provided a toy or model vehicle in which at least one of the wheels is formed with an intergral, eccentric lobe or cam co-acting with a member to be reciprocated or rotated, or with an intermediate member transmitting the motion.

The member may be pivoted to the chassis, in which case it reciprocates through an arc above the pivot, or it may be rotatably supported on the chassis, in which case it either rotates or pivots about an axis, or the member may be reciprocated rectilinearly. The member may be made in the form of a simulated engine in the car, the driver of the car or similar application. The device can also be used to reproduce some of the functions of a real car, such as reciprocation of the pistons, (in combination with a transparent cylinder block) or the operation of windscreen wipers.

SUMMARY OF THE INVENTION

According to the present invention, there is provided a toy vehicle with wheels and axles which are freely and independently rotatable in either direction. The axles are rotatable about their own longitudinal axis, and the wheels are mounted on the axles and are freely rotatable in either direction relative to the axles. An eccentric pin is formed integrally with at least one of the wheels, and a member on the vehicle is moveable relative to the rest of the vehicle. The pin cooperates randomly to provide transmitting motion to the member which is movable relative to the remainder of the vehicle.

In a further embodiment, the toy vehicle is provided with a simulated engine molding which is pivotable secured to the body of the toy and is engaged by the pin for locking the engine during movement of the toy. The simulated engine molding may be transparent and have at least one downwardly directed bore. A simulated piston may slide in the bore and be reciprocated by the pin. The pistons may have four bores and be molded in groups of two, with one group being raised by one pin, and the other group being raised and lowered by an auxiliary pin.

The member which is moveable relative to the remainder of the vehicle may be secured to a rotatable disc which has a surface with a ring of pins substantially parallel to the axis of rotation of the disc. The pin on the wheel interferes with the ring pins and thereby rotates the disc and the member during movement of the toy.

The member movable relative to the remainder of the toy may be in the form of a simulated turbine located at the rear of the vehicle. That member, on the other hand, may be moved indirectly by a train of components of which the first one is a wheel having the aforementioned pin. The train of components may consist of additionally, a disc having a ring of pins formed on one face parallel to the axis of rotation thereof, and a pinion formed on the other face. A gear, furthermore, can co-act with the pinion for the purpose of moving the member. The gear may be formed on one face with two upwardly extending pins that are different distances from the axis of rotation, and which are angularly spaced thereabout. The member to which movement is imparted has an axial rotation extending to the loci of the pins and includes a fin on the axis of rotation and extending into the locus of each pin, so that movement of one pin past the fin will cause angular displacement of the member in one direction. The movement of the other pin past the fin will cause angular displacement of the member in the opposite direction.

In accordance with the present invention, the train of components may also include additionally, a disc having a ring of pins parallel to its axis of rotation formed on one face, and the pin and cam of a Geneva wheel mechanism on the other pins. The member which may move relative to the rest of the vehicle may be secured to the cooperating Geneva wheel which is rotatably mounted in the vehicle.

For a better understanding of the invention, and to show how the same may be carried into effect, reference will now be directed, by way of example, to the accompanying drawings.

BRIEF DESCRIPTION OF THE DRAWING

FIG. 1 is a perspective view, partly broken away, of a toy or model vehicle according to the invention;

FIG. 2 is a perspective view of a wheel of the vehicle of FIG. 1;

FIG. 3 is a perspective view, partly broken away, of another embodiment of a toy or model vehicle according to the invention;

FIG. 5 is a perspective view, partly broken away, of a further embodiment of a toy or model vehicle according to the invention;

FIG. 6 is a perspective view of a part of the vehicle of FIG. 5;

DESCRIPTION OF THE PREFERRED EMBODIMENTS

Figure 4:
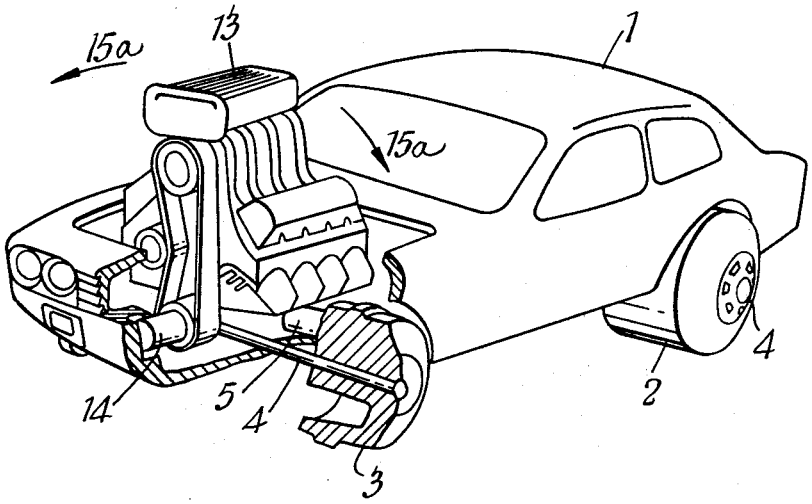
FIG. 4 is a perspective view, partly broken away, of yet another embodiment of a toy or model vehicle according to the invention.

Referring to the drawings, FIG. 1 shows a toy or model vehicle consisting essentially of a body 1, rear ground wheels 2 (of which only one is visible) and front ground wheels 3 and axles 4 on which the ground wheels are rotatably supported so as to be rotatable freely relative to the axles 4 in either direction. The axles 4 are preferably of a small gauge steel wire, in order that the free-running properties of the vehicle may be increased as far as possible by the reduction of friction in the wheel bearings, and are also rotatable about their longitudinal axes. The vehicle may be provided with suspension arrangements allowing resiliently opposed movement of the wheels relative to the chassis.

Other optional accessories such as window moldings, opening doors, boots and the like may be provided, all of which are well known in the art.

The wheels 2 and 3 are molded in a synthetic plastics material. At least one of the front wheels 3 is provided with an eccentric cam or lobe formed on that side of the wheel adjacent the chassis, that is, pointing towards the vehicle. In this case, the cam or lobe is in the form of a pin 5 molded on the wheel. The wheel is shown in section in FIG. 1, and is also illustrated in FIG. 2.

The bonnet of the toy or model vehicle is left as an aperture. Through this aperture projects a simulated engine molding 6. The rear end of the molding is pivoted in the body 1 by means of an integrally molded pair of stub shafts 7, only one of which is shown in the drawing. The front end of the engine molding rests either on the body 1 or on the lobe 5 of the wheel 3.

As the toy moves over the surface, the wheels rotate and the lobe 5 causes the engine molding 6 to reciprocate pivotably in the direction illustrated by the arrows 8.

A second embodiment of the invention is described with reference to FIG. 3 of the drawings. The toy or model vehicle illustrated consists as in the previous embodiment, of the body 1, a pair of rear ground wheels 2, a pair of front ground wheels 3 and two axles 4. In this case, both front wheels 3 are provided with lobes 5.

A molding 9 is provided that simulates the cylinder block and head of the engine. It is molded in a transparent plastics material and secured to the body 1 so as to project through the bonnet thereof. It is provided with a number of downwardly extending cylinders 10 that are open at the bottom. In this case there are four in line, but there could be more or less as desired, and a "V" configuration is possible.

The imitation engine is provided with piston moldings 11 and 12, each of which consists of a base having two cylindrical pistons upstanding therefrom. The moldings are so arranged that, in the example illustrated, the pistons of molding 11 extend into the first and third cylinders 10, whereas those of molding 12 extend into the second and fourth cylinders. As the toy or model vehicle is moved over a surface the front wheels 3 will be caused to rotate. One of the lobes 5 will then push its respective molding upwardly, causing the pistons attached thereto to rise in their cylinders. These pistons will then drop and the other pistons will then rise, assuming that the lobes 5 are 180° out of phase. As the molding 9 is transparent, the movement of the pistons is visible from the exterior. The molding of the pistons in pairs gives the correct firing order effect of a real engine.

Referring to FIG. 4, the toy or model vehicle shown therein is exactly similar to the vehicle in the previous embodiments, except that the engine molding is constituted by a molding 13 which has two stub shafts 14 located co-axially with the vehicle. The molding 13 may rock transversely of the car under the influence of the lobes 5 on the front wheel 3 of the vehicle, in an analogous manner to the motion of the molding 6 of FIG. 1. The molding 13 may be pivoted at its centre, as shown, and be rocked in both directions, as shown by the arrows 15*a*, or may be pivoted at one side, in which case only one of the front wheels 3 will be provided with a lobe, and the engine will return to its rest position under its own weight.

Referring to FIG. 5, the toy or model vehicle illustrated has a body 15, front ground wheels 16 and rear wheels 17, the ground wheels being freely rotatable in either direction on rotatable axles 18. Each rear wheel 16 is formed with a lobe constituted by a pin 19 extending from the outer rim thereof.

The rear of the vehicle is formed with a backwardly extending cowl 20 that is shaped to enclosed partially a pair of simulated turbine fans or impellers 21, one of which is shown in FIG. 6. Each impeller 21 is integrally molded with a shaft 22 that extends through a bore in the rear wall of the body 15. Each impeller is thus rotatable in the body 1.

A pinion 23 having a plurality of fairly widely-spaced pins 24 formed on its face is integrally molded with the impeller 21 and the shaft 22.

When the impellers are mounted in the body 15, and the vehicle is pushed across a surface, the lobe 19 in each case will interfere with one of the pins 15 and the simulated turbines will rotate. The rear wall of the body 15 may be painted black in order to give the impression that the vehicle is being driven by air moved by the turbine blades through ducts in the vehicle.

Figure 7:
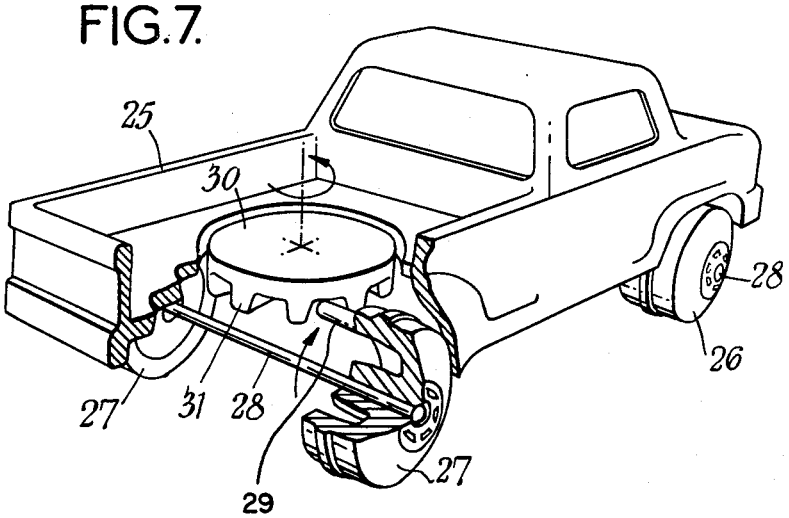
FIG. 7 is a perspective view, partly broken away, of another embodiment of the toy or model vehicle according to the invention.

Referring to FIG. 7, the toy or model vehicle shown is, in this case, a truck. It comprises a body 25, front wheels 26, rear wheels 27 and axles 28.

As in the previous embodiments, one of the rear wheels 27 is provided with a lobe constituted by a pin 29. In this case, however, only one of the wheels is so provided.

A large diameter disc 30 is rotatably supported in a horizontal position in the floor of the body 25. The disc 30 has molded on its lower periphery a series of downwardly extending pins 31.

When the vehicle is pushed over a surface, the pin 29 interferes with the series of pins 31, thus causing the disc 30 to index about its vertical axis. This movement may be used to cause rotation of a figure or part located on the disc. If the truck is made with a roof, then such items as imitation radar scanners, miniature advertising signs and so on can be mounted for rotation on the roof, connected to the disc 30 by an integrally molded spindle.

Figure 8:
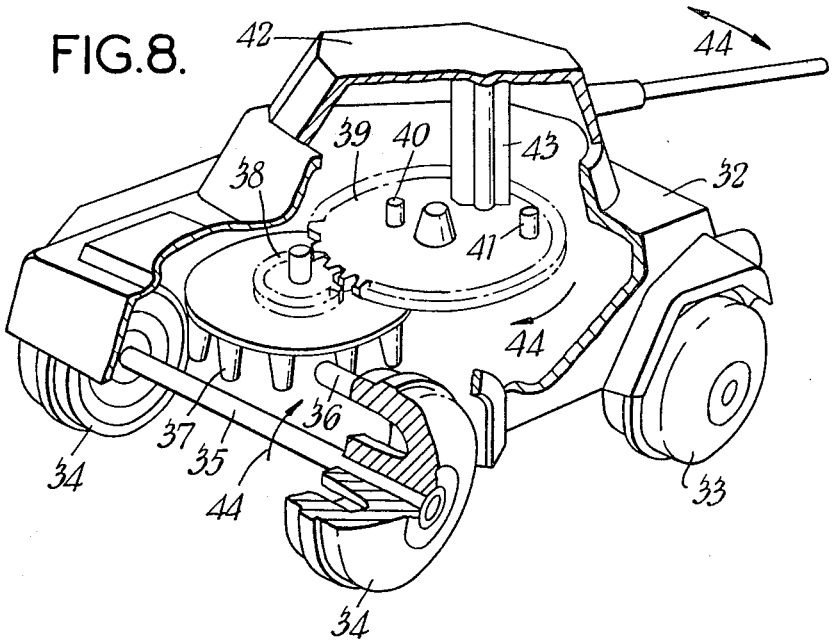
FIG. 8 is a perspective view, partly broken away, of a further embodiment of a toy or model vehicle according to the invention.

Referring to FIG. 8, the vehicle illustrated therein is an armored car. As in the previous embodiments, the vehicle comprises a body 32, front wheels 33, rear wheels 34, and an axle 35. Also as in the previous embodiments, one of the wheels 34 is provided with a lobe 36. A disc 37 having a series of downwardly depending pegs on its edge is rotatably mounted in a horizontal plane in the vehicle. The upper face of the disc 37 is provided with a pinion 38 of a reduced diameter. The pinion 38 meshes with a gear 39 of a larger diameter. The gear 39 has formed on its upper surface two pins 40 and 41, the pin 40 being relatively near the axis of rotation of the gear 39, and the pin 41 being relatively near the edge of the gear. The two pins are also angularly spaced about the axis of rotation.

A simulated gun turret 42 is rotatably supported on the body 32. On the axis of rotation there is located a downwardly extending fin 43. It will be seen from the drawing that one half of the fin 43 extends from the axis of rotation of the turret 42 towards the front of the vehicle and into the locus of movement of the pin 41. The other half of the fin 43 extends rearwardly into the locus of movement of the pin 40. The loci above-mentioned pass on opposite sides of the axis of rotation of the turret 42. It will be seen that as the pin 41 moves past the axis of rotation of the turret 42 it will push the fin 43 and thus rotate the turret 42 until the fin 43 is pushed an out of the way and the pin 41 is free to continue its rotation. The pin 40 will then abut against the other half of the fin 43, and, as it is moving in the same direction but on the opposite side of the axis of rotation of the turret 42, the turret will be rotated in the opposite direction to that movement caused by the pin 41. The general directions of movement of the mechanism are indicated by the arrows 44.

Figure 9:
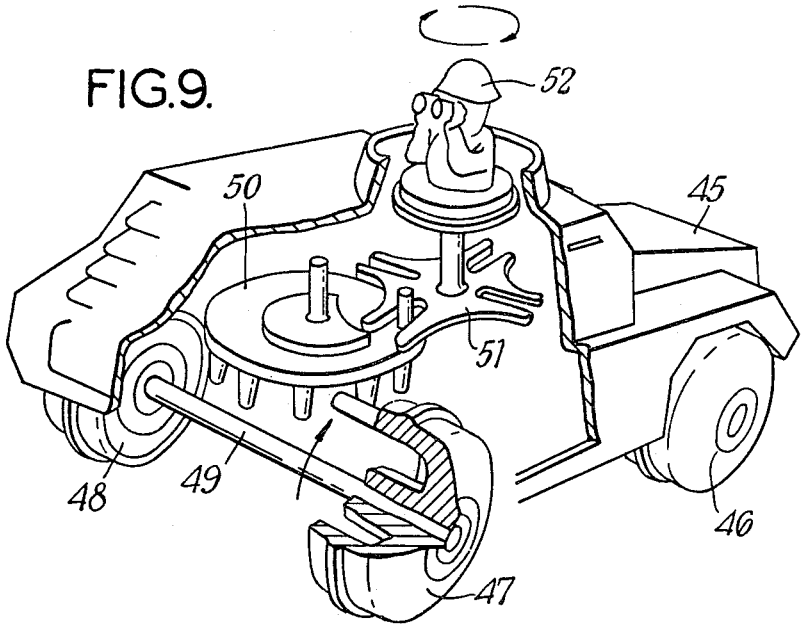
FIG. 9 is a perspective view of yet another embodiment of a toy or model vehicle according to the invention.

Referring to FIG. 9, the vehicle illustrated therein is a field command car. As before, the vehicle consists of a body 45, front wheels 46, rear wheels 47 and 48, and a rotatable axle 49 on which the rear wheels are freely rotatably supported. As before, the rear wheel 47 has an inwardly facing pin molded to its periphery. This pin interferes, during rotation, with a series of downwardly depending pegs formed on the lower surface of a disc 50 that is rotatably supported in a horizontal position in the body 45. The upper surface of the disc 50 is formed with the cam and pin of a standard Geneva Wheel stepping mechanism. The Geneva Wheel itself is rotatably supported adjacent the disc 50. The Geneva Wheel 51 is integrally molded with the part to which a stepping movement is imparted which projects through the roof of the vehicle. In this case, the part is the figure of a staff officer with binoculars. The figure is given periodic movements of 90° in order to "scan" the horizon.

It is also envisaged to use the reciprocatory or rotary drive according to the present invention for such items as toy drivers, windscreen wipers and so on. While embodiments describing front and rear drives only have been described, it will be obvious that a vehicle could have a molding being moved by both front and rear wheels, or the rear wheels could drive one movement and the front wheels another. A further alternative is to use one wheel for each of four mechanisms. Toy motor cars have been illustrated, but the invention is equally well applicable to most toy or model vehicles in which it is desired to add interest by providing a subsidiary part with a bobbing, reciprocating or rotary movement.

Without further analysis, the foregoing will so fully reveal the gist of the present invention that others can, by applying current knowledge, readily adopt it for various applications without omitting features that, from the standpoint of prior art, fairly constitute essential characteristics of the generic or specific aspects of this invention, therefore, such adaptations should and are intended to be comprehended within the meaning and range of equivalence of the following claims.

I claim:

1. A toy vehicle having wheels and axles freely and independently rotatable in either direction, said axles being rotatable about their longitudinal axes, said wheels being mounted on said axles and being freely rotatable in either direction relative to said axles; an eccentric pin formed integrally with at least one of said wheels; a member on said vehicle and movable relative to the rest of the vehicle; and means co-acting with said pin and transmitting motion to said member; said means including a rotatable disc to which said member is secured, one surface of said disc having a ring of pins substantially parallel to the axis of rotation of the disc, said pin on the wheel interfering with the ring of pins for rotating the disc and therefore the member during movement of the toy.

2. A toy as claimed in claim 1, wherein said member is a simulated turbine located at the rear of the vehicle.

3. A toy as claimed in claim 1, wherein said member is an intermediate member in a train of components of which the first is one ground wheel having said pin formed thereon.

4. A toy as claimed in claim 3, wherein said member comprises a pin and cam of a Geneva Wheel mechanism which is on the surface of said disc that faces away from said surface having said ring of pins, a further member being secured to the co-operating Geneva Wheel which is rotatably mounted in said vehicle.

5. A toy as claimed in claim 3, wherein said train comprises the wheel having said pin, said disc which has a pinion formed on its surface facing away from said ring of pins, and a gear co-acting with the pinion and adapted to move a further member, said pinion constituting the first mentioned member.

6. A toy as claimed in claim 5, wherein said gear is formed on one face with two upwardly extending pins that are different distances from the axis of rotation of said gear and that are angularly spaced thereabout, said further member to which movement is to be imparted having an axis of rotation extending between the loci of movement of the pins, said further member also including a fin on said axis of rotation of said further member and extending to the locus of movement of each pin, so that movement of one pin past the fin will cause angular displacement of said further member in one direction, and movement of the other pin past the fin will cause angular displacment of said further member in the opposite direction.

* * * * *